United States Patent [19]

Dubost et al.

[11] Patent Number: 4,758,286

[45] Date of Patent: Jul. 19, 1988

[54] HEAT TREATED AND AGED AL-BASE ALLOYS CONTAINING LITHIUM, MAGNESIUM AND COPPER AND PROCESS

[75] Inventors: Bruno Dubost, Saint Egreve; Philippe Meyer, Voiron, both of France

[73] Assignee: Cegedur Societe de Transformation de l'Aluminium Pechiney, Paris, France

[21] Appl. No.: 752,194

[22] PCT Filed: Nov. 22, 1984

[86] PCT No.: PCT/FR84/00273

§ 371 Date: Jun. 24, 1985

§ 102(e) Date: Jun. 24, 1985

[87] PCT Pub. No.: WO85/02416

PCT Pub. Date: Jun. 6, 1985

[30] Foreign Application Priority Data

Nov. 24, 1983 [FR] France ..... 8319070

[51] Int. Cl.[4] ..... C22F 1/04

[52] U.S. Cl. ..... 148/12.7 A; 148/159; 148/417

[58] Field of Search ..... 420/533, 534, 535, 532; 148/11.5 A, 12.7 A, 159, 417, 439

[56] References Cited

U.S. PATENT DOCUMENTS 4,526,630 7/1985 Field ..... 148/159

FOREIGN PATENT DOCUMENTS 142261 5/1985 European Pat. Off. .

1220961 3/1960 France .

1519021 3/1968 France .

2115836 9/1983 United Kingdom .

OTHER PUBLICATIONS

Alloys Index, vol. 9, American Society for Metals and Metal Society, pp. E-21, E-22, 1982.

NASA Contractor Report 3578, P. P. Pizzo, 1982.

*Primary Examiner*—R. Dean

*Attorney, Agent, or Firm*—Dennison, Meserole, Pollack & Scheiner

[57] ABSTRACT

The present invention relates to Al-base alloys essentially containing additions of Li, Mg and Cu and possibly minor additions of Cr, Zr, Ti and Mn, which have high specific mechanical characteristics, a low density and good resistance to corrosion.

The alloys according to the invention contain (in % by weight): Li 1.8 to 3.5; Mg 1.4 to 6.0; Cu 0.2 to 1.6 with Mg/Cu≧1.5; Cr up to 0.3; Mn up to 1; Zr up to 0.2; Ti up to 0.1 and/or Be up to 0.02, Fe up to 0.20; Si up to 0.12; Zn up to 0.35%.

The homogenization and solution treatments must be taken to a sufficiently advanced stage to dissolve the quaternary intermetallic phases (Al, Li, Mg, Cu) which are larger than 5 μm in size. Such alloys present a compromise between their mechanical characteristics and their density, which is higher than that of the knwn Al Cu Mg alloys, and alloys containing Li.

14 Claims, No Drawings

HEAT TREATED AND AGED AL-BASE ALLOYS CONTAINING LITHIUM, MAGNESIUM AND COPPER AND PROCESS

The present invention relates to Al-base alloys containing Li, Mg and Cu and having mechanical characteristics equivalent to those of conventional aluminium alloys with precipitation hardening and of average strength, with a density which is reduced by at least 9% with respect to such conventional alloys.

Metallurgists are aware that the addition of lithium reduces density and increases the modulus of elasticity and the mechanical strength of aluminium alloys. That explains the attraction to designers of such alloys for uses in the aeronautical industry and more particularly lithium-bearing aluminium alloys containing other additive elements such as magnesium or copper. However, it is absolutely essential that such lithium-containing alloys enjoy ductility and tenacity that are at least equivalent, with the same mechanical strength, to that of conventional aeronautical alloys such as alloys 2024-T4 or T351, 2214-T6(51), 7175-T73(51) or T7652 and 7150-T651 (using the Aluminium Association nomenclature), which is not the case with the known lithium-containing alloys.

In the aluminium-lithium-magnesium system, the only known industrial alloy is the Soviet alloy 01420, of the following nominal composition (in % by weight): Li=2.0 to 2.2; Mg=5.0 to 5.4; Mn=0 to 0.6; Zr=0 to 0.15. That alloy imparts mediumly elevated tensile mechanical properties to thin plates and extruded products which have been subjected to treatment, in state T6 (16 hours at 170° C.) (FRIDLYANDER et al. Met. Science and Heat Treatment No 3-4, April 1968, page 212, translation of Metalov. i. Term. Obrab. Metallov No 3, page 5052, March 1968), with such characteristics being worse than those of the conventional aeronautical alloys. Moreover, study in regard to the statistical laws in respect of modification of the characteristics of alloys of the Al-Li-Mg-Zr system, in dependence on their contents of Li and Mg (I. N. FRIDLYANDER et al. "Zavod. Lab.", July 1974, T7, page 847) shows that it is not possible to enhance the compromise between mechanical strength and elongation of that alloy, to the level of the conventional aeronautical alloys, by reducing the amounts of lithium and magnesium. Those trends are confirmed by the results obtained by SANDES (final report NADC Contract No N 622 69-74-C-0438, June 1976), showing that the compromise between elastic limit and tenacity of the extruded products of Al-Li-Mg alloys becomes higher in proportion to a reducing amount of lithium and, to a lesser degree, a reducing amount of magnesium. In particular, the authors show that alloys with high overall proportions of lithium+-magnesium, in the quenched and tempered state, have a compromise as between mechanical strength, ductility and tenacity, which is much lower than that of the conventional alloys of series 2000 and 7000.

More recently, metallurgists have proposed novel compositions of aluminium-lithium alloys containing copper (Cu=1.5 to 3%) and magnesium (Mg=0.5 to 1.4%), of low density and high mechanical strength. That is in particular experimental alloy F92 (British Specification DXXXA), of the following nominal composition (in % by weight): Li=2.5; Cu=1.2; Mg=0.7; Zr=0.12, wherein the compromises in respect of type mechanical characteristics as announced in 1983 by British ALCAN, on thin sheets in the state T8 (Rm=500 MPa; Rp 0.2=420 MPa; A=6%) and on thick sheets in the state T651 (Rm=520 MPa; Rp 0.2=460 MPa; A=7%) show that that alloy has a compromise as between mechanical strength and ductility, which is even lower than that of the aeronautical alloys of series 2000 and 7000, like all the other alloys of Al-LiCu and AlLiCuMg systems with a lithium content of more than 2%, which are known to date.

In the course of metallurgical tests, we have found and experimented with novel compositions of industrial alloys of the system Al-Li-Mg-Cu (+Cr, Mn, Zr, Ti) with higher levels of performance than alloys of the systems AlCuMg (2024), AlLiCu and AlLiMg and than the known alloys of the system AlLiCuMg, from the point of view of the compromise between mechanical strength, density and resistance to inter-granular or flaking corrosion.

The new alloys according to the invention are of the following compositions by weight:

| | |
|---|---|
| Li 1.8 to 3.5% | |
| Mg 1.4 to 6.0% | with Mg/Cu ≧ 1.5 |
| Cu 0.2 to 1.6% | |
| Fe ≦ 0.20% | |
| Si ≦ 0.12% | |
| Cr 0 to 0.3% | |
| Mn 0 to 1.0% | |
| Zr 0 to 0.2% | |
| Zn 0 to 0.35% | |
| Ti 0 to 0.1% | |
| Be 0 to 0.02% | |
| other elements (impurities) | |
| each < 0.05% | |
| total < 0.15% | |
| balance: aluminium. | |

The amount of principal elements is preferably maintained individually or in combination between 2.3 and 3.3 for Li, 1.4 and 5% for Mg and 0.25 and 1.2% for Cu. The amount of Zr is preferably between 0.08 and 0.18%.

In order to achieve a better compromise in regard to mechanical strength and density, the following relationship must also be observed:

$$\%Li(\%Cu+2)+\%Mg=K$$

with $8.5 \leqq K \leqq 11.5$ and preferably $9 \leqq K \leqq 11$.

The alloys according to the invention have their optimum strength and ductility after treatment for homogenization of the cast products and solution treatment of the transformed products comprising at least one stage at a temperature $\theta$ (in °C.) of the order of $\theta=535-5$ (% Mg) for a sufficient period of time that, after quenching, the intermetallic compounds of the quaternary phases (AlLiCuMg) which can be detected upon micrographic examination or by electronic or ionic microanalysis (SIMS) are of a size of less than 5 μm. The homogenization treatment may be carried out in a temperature range of from $\theta+10$ (°C.) to $\theta-20$ (°C.), and the solution treatment is preferably carried out at between $\theta \pm 10°$ C.

The optimum periods for thermal homogenization treatment at the temperature $\theta$ are from 0.5 to 8 hours for the alloys which are produced by rapid solidification (atomization-splat cooling—or any other means) and from 12 to 72 hours for cast products or products which are produced by a semi-continuous casting operation.

Those alloys have their optimum mechanical properties after tempering operations for periods of from 8 to 48 hours at temperatures of from 170° to 220° C. and it is preferable for the products of suitable shape (sheets, bars, billets) to be subjected to a cold hardening operation which gives rise to a degree of plastic deformation of from 1 to 5% (preferably from 2 to 4%) between quenching and tempering, which permits the mechanical strength of the products to be further improved.

Under those conditions, the alloys according to the invention have a mechanical strength which is higher than that of the alloy AlLiMgMn 01420, which did not permit the results of the studies available on the system to be foreseen. We have found that the alloys according to the invention have a compromise as between mechanical characteristics and density, which is higher than that of the known AlLiCuMg alloys (with small proportions of magnesium). They also have a satisfactory degree of resistance to intergranular or flaking corrosion which is much higher than that of the known AlCuMg, AlLiCu and AlLiCuMg alloys.

Those alloys are therefore a particularly attractive proposition for the production of cast or rolled semi-manufactured products (produced by semi-continuous casting, atomization or rapid solidification, etc.), whether such products are for example extruded, rolled, forged, stamped or drop forged products which are used in particular in the aeronautical and space industries.

In particular, it was surprisingly found that the alloys according to the invention, with high contents of Li and Mg, could be cast without major difficulty in a semi-continuous casting process in the form of billets or plates of industrial format (no cracks and porosity).

The invention will be better appreciated and illustrated by means of the following examples:

EXAMPLES

Using a semi-continuous casting process, we produced billets of a diameter of 200 mm, comprising aeronautical aluminium alloys of known compositions and different lithium-containing alloys according to the invention. The billets were subjected to long-duration homogenization operations at a sufficient temperature to dissolve almost all the eutectic phases, which were transformed, after an operation of removing the crust, into flat sections measuring 100 mm in width and 13 mm in thickness.

These sections were subjected to solution treatment under conditions which were considered to be the optimum conditions from the point of view of dissolving the phases which have high proportions of main additive elements (Li, Cu, Mg, Zn) and then quenched with cold water (20° C.) before being subjected to a controlled traction operation giving 2% of remanent deformation and different tempering temperatures in a ventilated furnace for a period of 24 hours. Certain extruded sections were not subjected to the traction operation between quenching and tempering, so as to show the influence of the cold hardening operation, performed between quenching and tempering, on the mechanical properties.

All the sections when produced in that way were characterised by traction and density-measurement tests. Tests in respect of sensitivity to intergranular corrosion in accordance with the standard AIR 9048 (continuous immersion for 6 hours in an NaCl—$H_2O_2$ solution) and flaking corrosion in accordance with the EXCO test (continuous immersion for 96 hours in accordance with the standard ASTM G 34-79) were also carried out.

Table I gives the chemical compositions of the alloys as measured by atomic absorption and spark emission spectrometry, and their characteristics (coefficient K) with respect to the ranges according to the invention.

Table II gives the mechanical tensile characteristics and density in dependence on the chemical composition of the sections for different heat treatments performed and the degree of cold working between quenching and tempering. The table gives the yield strength, (Rp 0.2), tensile strength (Rm) and elongation at rupture (A%).

Table III gives the results obtained in the corrosion tests.

The results of the tests in respect of sensitivity to intergranular corrosion and flaking corrosion, which were carried out, for certain tempered states in state T651, show that the alloys according to the invention have enhanced resistance to corrosion in comparison with the conventional alloys of the series 2000 and the known lithium-containing alloys which have a lower proportion of Mg.

The whole of the results obtained shows therefore that the alloys according to the invention have levels of mechanical strength comparable to those of alloys of series 2000, without lithium, which are used at the present time in aeronautics, and higher than those of the known Al-Li-Mg alloys (for example the alloy 01420), with the advantage of a substantially lower density than that of the conventional alloys and lower than that of the known lithium-containing alloys of the systems Al-Li-Cu, Al-Li-Cu-Mg. They also show the attraction of a cold working operation between quenching and tempering, in regard to the mechanical properties obtained.

TABLE I

Chemical compositions of extruded flat members of conventional alloys and Li-containing alloys which are known and in accordance with the invention.

| Reference | Alloy | | Chemical composition (amounts by weight) | | | | | | | | | |
|---|---|---|---|---|---|---|---|---|---|---|---|---|
| Designation | Type | K | Li | Mg | Cu | Zn | Cr | Mn | Zr | Ti | Fe | Si |
| 2024 | convent. | — | 0 | 1.33 | 4.38 | — | — | 0.75 | — | 0.02 | 0.18 | 0.09 |
| 7474 | convent. | — | 0 | 2.36 | 1.32 | 5.7 | 0.21 | 0.02 | — | 0.02 | 0.09 | 0.06 |
| 01420 | refer. | — | 2.15 | 5.40 | 0 | — | — | 0.20 | — | 0.02 | 0.03 | 0.03 |
| DTDXXXA | refer. | — | 2.28 | 0.75 | 1.32 | — | — | 0.01 | 0.14 | 0.04 | 0.04 | 0.03 |
| 1 | invent. | 10.2 | 2.7 | 3.8 | 0.36 | — | — | — | 0.10 | 0.03 | 0.02 | 0.02 |
| 2 | invent. | 9.3 | 3.1 | 1.9 | 0.58 | — | — | — | 0.10 | 0.02 | 0.02 | 0.02 |
| 3 | invent. | 10.5 | 3.2 | 1.5 | 0.80 | — | — | — | 0.10 | 0.02 | 0.02 | 0.02 |
| 4 | outside the | — | 3.0 | 4.5 | 0.02 | — | — | — | 0.12 | 0.02 | 0.02 | 0.02 |

TABLE I-continued

| Chemical compositions of extruded flat members of conventional alloys and Li-containing alloys which are known and in accordance with the invention. | | | | | | | | | | | | |
|---|---|---|---|---|---|---|---|---|---|---|---|---|
| Reference | Alloy | | Chemical composition (amounts by weight) | | | | | | | | | |
| Designation | Type | K | Li | Mg | Cu | Zn | Cr | Mn | Zr | Ti | Fe | Si |
| | invention | | | | | | | | | | | |

TABLE II

| Conditions of thermal and thermomechanical treatment operations, density and mechanical tensile characteristics of extruded billets | | | | | | | | | | |
|---|---|---|---|---|---|---|---|---|---|---|
| Alloy | | Den- | | Solution | Controlled | | Mechanical characteristics | | | |
| Reference | Treatment | sity | Homogenization | treatment | traction % | Tempering | Direc- tion* | Rp 0.2 (MPa) | Rm (MPa) | A 5d % |
| 2024 | convent. | 2.79 | 8 hour - 490° C. | 2 h - 490° C. | 2.1 | T351 | L | 401 | 530 | 12.3 |
| | | | | | | | TL | 342 | 491 | 19.0 |
| 7475 | convent. | 2.80 | 16 hour - 470° C. | 2 h - 475° C. | 2.0 | T7351 | L | 460 | 530 | 11.6 |
| | | | | | | (6 h at 107° C. + 24 h at 160° C.) | TL | 446 | 517 | 13.1 |
| 01420 | refer. | 2.49 | 14 hour - 500° C. | 1 h - 500° C. | 2.0 | 16 h - 170° C. | L | 360 | 480 | 8.0 |
| | | | | | | | TL | 325 | 448 | 8.5 |
| DTDXXA | refer. | 2.55 | 24 hour - 538° C. | 2 h - 538° C. | 3.5 | 12 h - 190° C. | L | 462 | 523 | 4.6 |
| | | | | | | | TL | 399 | 487 | 7.0 |
| 1 | invent. | 2.47 | 48 hour - 520° C. | 6 h - 520° C. | 2 | 24 h - 170° C. | L | 421 | 520 | 6.0 |
| | | | | | | | TL | 379 | 527 | 7.0 |
| 2 | invent. | 2.48 | 48 hour - 535° C. | 6 h - 535° C. | 2 | 24 h - 170° C. | L | 444 | 522 | 4.0 |
| | | | | | | | TL | 426 | 567 | 6.0 |
| 2 | invent. | 2.48 | 48 hour - 535° C. | 6 h - 535° C. | 2 | 24 h - 190° C. | L | 462 | 520 | 4.0 |
| | | | | | | | TL | 444 | 523 | 6.0 |
| 3 | invent. | 2.48 | 72 hour - 535° C. | 2.5 h - 538° C. | 2 | 24 h - 170° C. | L | 456 | 565 | 5.0 |
| | | | | | | | TL | 432 | 570 | 6.0 |
| 3 | invent. | 2.48 | 72 hour - 535° C. | 2.5 h - 538° C. | 2 | 24 h - 210° C. | L | 452 | 568 | 5.0 |
| | | | | | | | TL | 427 | 572 | 6.0 |
| 1 | invent. | 2.47 | 48 hour - 520° C. | 6 h - 520° C. | 0 | 24 h - 170° C. | L | 370 | 535 | 8.0 |
| | | | | | | | TL | 373 | 533 | 7.0 |
| 2 | invent. | 2.48 | 48 hour - 535° C. | 6 h - 535° C. | 0 | 24 h - 170° C. | L | 378 | 532 | 8.0 |
| | | | | | | | TL | 371 | 516 | 8.0 |
| 2 | invent. | 2.48 | 48 hour - 535° C. | 6 h - 535° C. | 0 | 24 h - 190° C. | L | 394 | 509 | 7.0 |
| | | | | | | | TL | 383 | 519 | 7.0 |
| 4 | outside the invention | 2.43 | 8 hour - 470° C. + 24 hour - 520° C. | 2 h - 522° C. | 0 | 24 h - 200° C. | L | 354 | 495 | 5.0 |
| | | | | | | | TL | 362 | 490 | 4.0 |

*L: longitudinal direction
TL: long transverse direction

TABLE III

| Corrosion tests | | | | |
|---|---|---|---|---|
| Alloy | Trac- ion rates | Tempering | Inter- granular corrosion* | Flaking corro- sion* |
| 2024 | 2.1% | T351 | I | EB |
| DTDXXXA | 3.5% | 12 hour - 190° C. | I + P | EB |
| 1 | 2% | 24 hour - 170° C. | P | P |
| 2 | 2% | 24 hour - 190° C. | P | P |
| 3 | 2% | 24 hour - 210° C. | P (+I) | P |

*I marked intergranular corrosion
(I) local intergranular corrosion
P pitting
EB marked flaking corrosion

We claim:

1. A heat treated and aged Al-base alloy having high strength and high ductility consisting essentially of (in % by weight):

Li = 1.8 to 3.5
Mg = 1.4 to 6.0
Cu = 0.2 to 1.6%
} with Mg/Cu ≧ 1.5
Fe ≦ 0.20
Si ≦ 0.12
Cr 0 to 0.3
Mn 0 to 1.0
Zr 0 to 0.2
Ti 0 to 0.1

-continued

Be 0 to 0.02
Zn 0 to 0.35
other elements (impurities)
each < 0.05
total < 0.15
balance: aluminium.

2. Alloy according to claim 1 characterised in that it contains from 2.3 to 3.3% Li.

3. Alloy according to claim 1 characterised in that it contains from 0.25 to 1.2% Cu.

4. Alloy according to claim 1 characterised in that it contains from 1.4 to 5% Mg.

5. Alloy according to one of claims 1 to 4 characterised in that it contains from 2.3 to 3.3% Li, 0.25 to 1.2% Cu and 1.4 to 5% Mg.

6. Alloy according to claim 1 characterised in that:

$$\%Li(\%Cu+2)+\%Mg=K$$

with $8.5 \leqq K \leqq 11.5$.

7. Alloy according to claim 6 characterised in that $9 \leqq K \leqq 11$.

8. A process for the heat treatment of the alloys according to claim 1 comprising a homogenization operation, a solution treatment, a quenching operation and a tempering operation, characterised in that the alloy is subjected to homogenization and solution treatment at a temperature (in °C.) of the order of $\theta = 535 - 5$ (% Mg).

9. A process according to claim 8 characterised in that the duration of the homogenization operation and the solution treatment is sufficiently long that, after the quenching operation, the residual quaternary intermetallic phases (Al, Li, Mg, Cu) are less than 5 $\mu$m in size.

10. A process according to claim 8 or claim 9 characterised in that the homogenization operation is carried out in the temperature range which is defined by $\theta + 10$ (°C.) and $\theta - 20$ (°C.).

11. A process according to claim 8 or claim 9 characterised in that the solution treatment is carried out in the temperature range defined by $\theta + 10$ (°C.) and $\theta - 10$ (°C.).

12. A process according to claim 8 or claim 9 characterised in that the tempering operation is effected at from 170° to 220° C. for a period ranging from 8 to 48 hours.

13. A process according to claim 8 or claim 9 characterised in that plastic deformation of from 1 to 5% is applied to the treated product between the quenching and tempering operations.

14. A process according to claim 13, wherein said plastic deformation is from 2 to 4%.

* * * * *